US011244653B2

(12) United States Patent
Tang et al.

(10) Patent No.: US 11,244,653 B2
(45) Date of Patent: Feb. 8, 2022

(54) DRIVING METHOD AND DRIVING DEVICE OF DISPLAY PANEL, AND DISPLAY DEVICE

(71) Applicant: WuHan TianMa Micro-Electronics Co., Ltd., Wuhan (CN)

(72) Inventors: Yuejun Tang, Wuhan (CN); Xudong Liang, Wuhan (CN); Yongzhi Wang, Wuhan (CN); Tao Peng, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 10 days.

(21) Appl. No.: 16/729,311

(22) Filed: Dec. 28, 2019

(65) Prior Publication Data

US 2020/0135147 A1 Apr. 30, 2020

(30) Foreign Application Priority Data

Sep. 11, 2019 (CN) ..... 201910859706.6

(51) Int. Cl.
*G09G 5/10* (2006.01)

(52) U.S. Cl.
CPC ..... *G09G 5/10* (2013.01); *G09G 2320/0233* (2013.01); *G09G 2320/0686* (2013.01); *G09G 2320/0693* (2013.01)

(58) Field of Classification Search
CPC ..... G09G 5/10; G09G 2320/0233; G09G 2320/0686; G09G 2320/0693
See application file for complete search history.

(56) References Cited

U.S. PATENT DOCUMENTS

2005/0151711 A1* 7/2005 Baek ..... G09G 3/2003 345/88
2009/0160880 A1* 6/2009 Park ..... G09G 3/3233 345/690
2014/0340431 A1* 11/2014 Yamakawa ..... G09G 3/3426 345/690
2015/0070337 A1* 3/2015 Bell ..... G09G 3/007 345/207
2019/0130872 A1* 5/2019 Furihata ..... G09G 5/10
(Continued)

FOREIGN PATENT DOCUMENTS

CN 108962126 A 12/2018
CN 109064966 A 12/2018
CN 109521591 A 3/2019

*Primary Examiner* — Chanh D Nguyen
*Assistant Examiner* — Ngan T. Pham-Lu
(74) *Attorney, Agent, or Firm* — Kilpatrick Townsend & Stockton, LLP

(57) ABSTRACT

The present disclosure discloses a driving method and driving device of a display panel and a display device. Under the partial display mode, different gamma curves may be called for different display regions, to drive different regions of the same picture. In one embodiment, a first gamma curve with relatively low brightness may be called for a first display region provided with an under screen sensor, that is, the first display region is driven by the first gamma curve with the relatively low brightness. A second gamma curve with relatively high brightness may be called for a second display region in normal display, that is, the second display region is driven by the second gamma curve with the relatively high brightness.

16 Claims, 6 Drawing Sheets

(56) References Cited

U.S. PATENT DOCUMENTS

| | | | | |
|---|---|---|---|---|
| 2020/0234634 | A1* | 7/2020 | Li | G09G 3/3233 |
| 2020/0279534 | A1* | 9/2020 | Ji | G09G 3/3648 |
| 2020/0394983 | A1* | 12/2020 | Huang | G06F 3/16 |
| 2021/0012717 | A1* | 1/2021 | Park | G09G 3/3258 |

* cited by examiner

DRIVING METHOD AND DRIVING DEVICE OF DISPLAY PANEL, AND DISPLAY DEVICE

CROSS REFERENCES

This application claims priority to Chinese Patent Application No. 201910859706.6, filed on Sep. 11, 2019, which is hereby incorporated by reference in its entirety.

FIELD

The present disclosure relates to the field of display, and particularly to a driving method and driving device of a display panel, and a display device.

BACKGROUND

With the development of display electronic products such as mobile phones, it is a product trend to increase a screen-to-body ratio of an organic light emitting diode display panel, and functional elements, such as a front camera, necessary for mobile phones are sure to become a major factor for restricting the increase of the screen-to-body ratio.

In view of this problem, a solution of an under screen camera has been provided. An application terminal such as a mobile phone includes two display regions, and parts such as the under screen camera and functions are set below one of the display regions. When the same current is loaded to the two display regions, the display region with an under screen sensor (including a camera) has relatively low brightness, so that when this type of display is applied to the application terminal such as the mobile phone, higher current may be provided to the display region with the under screen sensor, or the supplied driving voltage has a larger duty cycle, or the supplied driving voltage is higher in order to ensure that the display has relatively high brightness uniformity.

SUMMARY

Embodiments of the present disclosure provide a driving method and driving device of a display panel, and a display device.

An embodiment of the present disclosure provides a driving method of a display panel, including: monitoring a display mode of the display panel when the display panel displays a picture, and the display panel includes a first display region and a second display region, and the first display region is a semi-transparent region configured to set an under screen sensor; when the display mode is monitored to be a partial display mode, for first pixels in the first display region: calling a pre-stored first gamma curve, generating corresponding display information based on the first gamma curve, and driving the first pixels; for second pixels in the second display region: calling a pre-stored second gamma curve, generating corresponding display information based on the second gamma curve, and driving the second pixels, and a maximum brightness value corresponding to a maximum gray-scale value in the first gamma curve is a first maximum brightness value, and a maximum brightness value corresponding to a maximum gray-scale value in the second gamma curve is a second maximum brightness value, and the first maximum brightness value is less than the second maximum brightness value.

An embodiment of the present disclosure further provides a driving device of a display panel, including: a storing component, configured to store a first gamma curve and a second gamma curve, and a maximum brightness value corresponding to a maximum gray-scale value in the first gamma curve is a first maximum brightness value, and a maximum brightness value corresponding to a maximum gray-scale value in the second gamma curve is a second maximum brightness value, and the first maximum brightness value is less than the second maximum brightness value; a monitoring component, configured to monitor a display mode of the display panel when the display panel displays a picture, and the display panel includes a first display region and a second display region, and the first display region is a semi-transparent region configured to set an under screen sensor; a calling component, configured to call a pre-stored first gamma curve for first pixels in the first display region and call a pre-stored second gamma curve for second pixels in the second display region when the monitoring component monitors that the display mode is a partial display mode; a generating component, configured to generate corresponding display information based on the first gamma curve and drive the first pixels, and generate corresponding display information based on the second gamma curve and drive the second pixels.

An embodiment of the present disclosure further provides a display device, including: a display panel, including a first display region and a second display region, and the first display region is a semi-transparent region configured to set an under screen sensor; a sensor arranged corresponding to the first display region; and the above driving device provided by the embodiment of the present disclosure.

DETAILED DESCRIPTION OF THE EMBODIMENTS

With the development of display electronic products such as mobile phones, it is a product trend to increase a screen-to-body ratio of an organic light emitting diode display panel, and functional elements, such as a front camera, necessary for mobile phones have become a major factor for restricting the increase of the screen-to-body ratio.

In view of this problem, a solution of an under screen camera has been provided. An application terminal such as a mobile phone includes a first display region M and a second display region N. The first display region M includes parts such as the under screen camera and functions. Second pixels in the second display region N are normally arranged. An opening area of first pixels in the first display region M is reduced to set a light transmittance region. Or, a pixel density of the first pixels in the first display region M is decreased to set the light transmittance region, thus causing that the first display region M has relatively low brightness when the same current is loaded to the first display region M and the second display region N.

Therefore, when this type of display is applied to an application terminal such as the mobile phone, higher current may be provided to the first display region M than the second display region N, or the supplied driving voltage has a larger duty cycle, or the supplied driving voltage is higher in order to ensure that the display has relatively high brightness uniformity, which will lead to a problem of the shortened display life of the first display region N, namely a problem that the first display region M has shorter display life than the second display region N, and bring a poor use experience to a user.

In view of the problem of short life of a region with an under screen sensor of the display panel in the related art, embodiments of the present disclosure provide a driving method and driving device of a display panel, and a display device.

Figure 1:
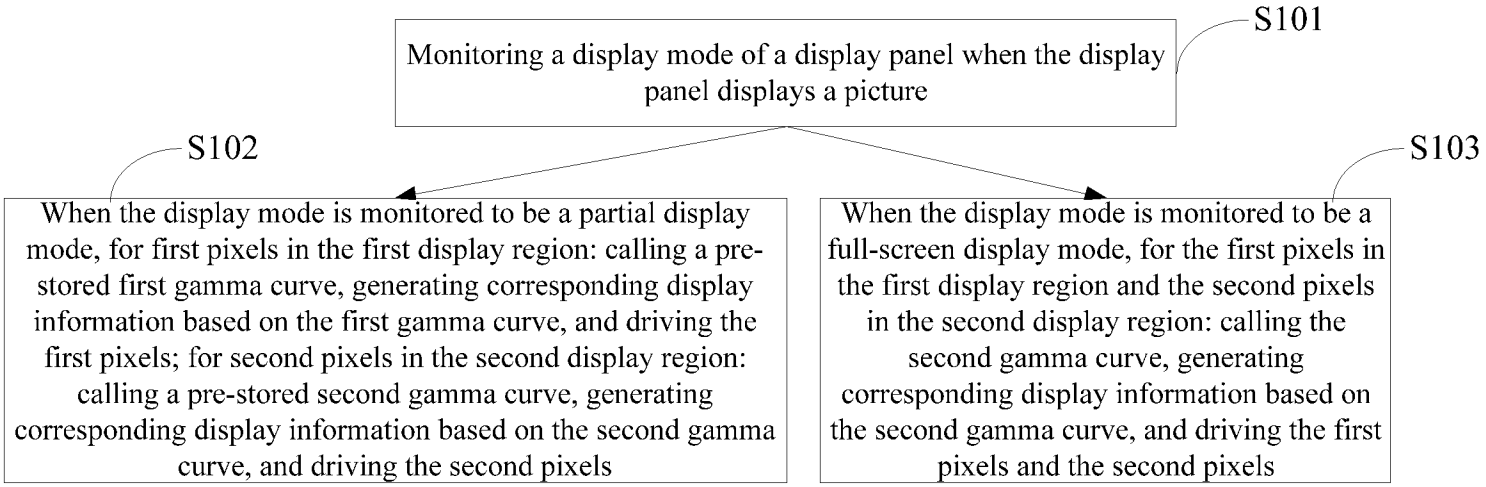
FIG. 1 is a flow diagram of a driving method provided by an embodiment of the present disclosure.

Embodiments of the present disclosure describe the driving method and driving device of the display panel, and the display device which are provided by the embodiments of the present disclosure are described in detail below in conjunction with the accompanying drawings. A driving method of a display panel, provided by the embodiments of the present disclosure, as shown in FIG. 1, includes the following steps.

S101, a display mode of the display panel is monitored when the display panel displays a picture. The display panel includes a first display region and a second display region, and the first display region is a semi-transparent region configured to set an under screen sensor.

Figure 2:
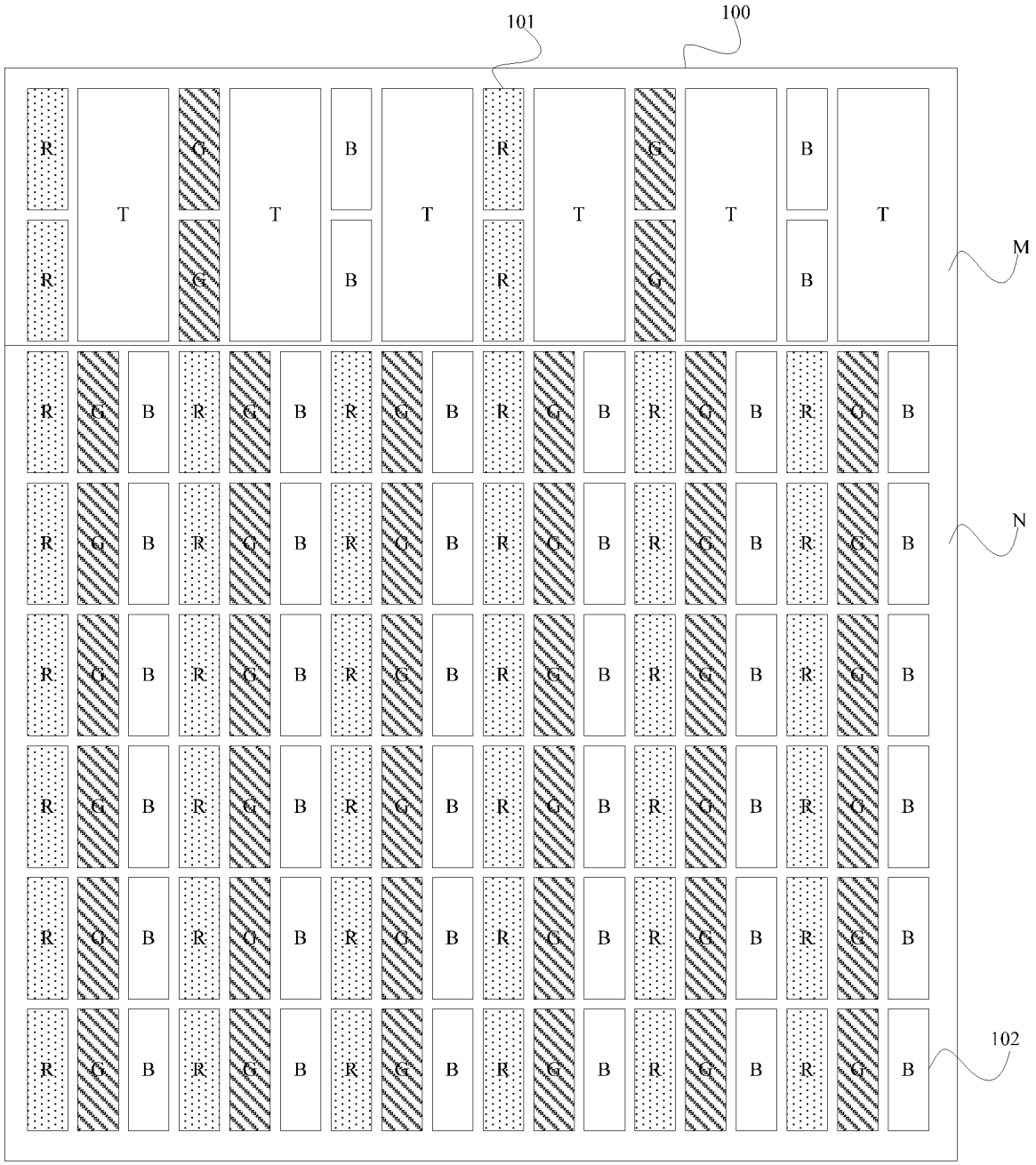
FIG. 2 is a schematic diagram of pixels arrangement of a display device provided by an embodiment of the present disclosure.

In some embodiments, in order to set a light transmittance region T in the first display region the under screen sensor realizes image acquisition and other functions through the light transmittance region T, as shown in FIG. 2, a pixel density of first pixels 101 in the first display region M of the display panel 100 may be less than a pixel density of second pixels 102 in the second display region N, that is, the second pixels 102 in the second display region N are normally arranged, the number of the first pixels 101 within a unit area in the first display region M is decreased to reduce the pixel density of the first pixels 101, to set the light transmittance region T in the first display region M.

Figure 3:
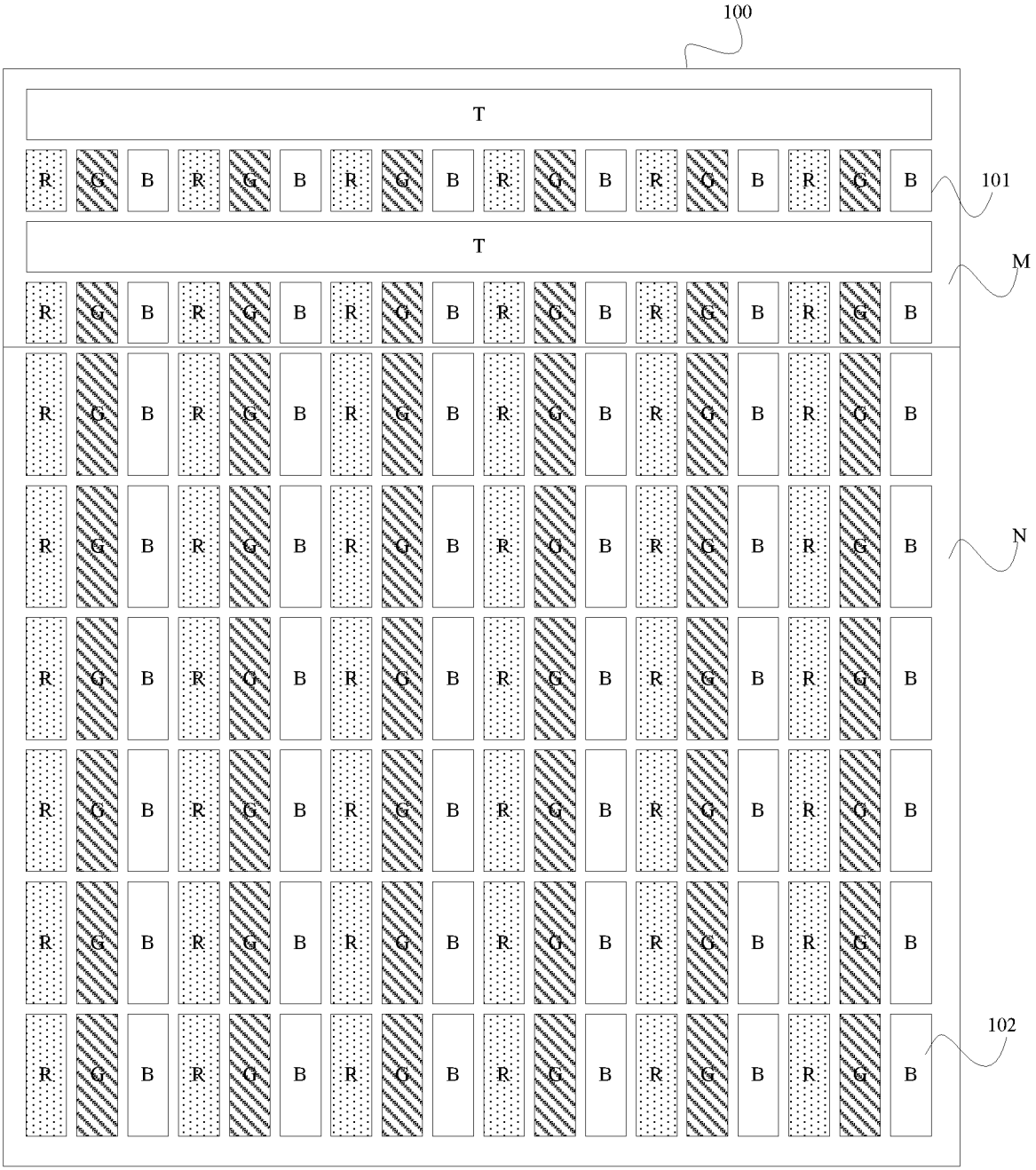
FIG. 3 is a schematic diagram of pixels arrangement of a display device provided by an embodiment of the present disclosure.

In one embodiment, as shown in FIG. 3, an opening area of the first pixels 101 in the first display region M of the display panel 100 may be less than an opening area of the second pixels 102 in the second display region N, that is, the second pixels 102 in the second display region N are normally arranged, an opening region of the respective first pixels 101 in the first display region M is narrowed, to set the light transmittance region T in the first display region M to realize the image acquisition and other functions of the under screen sensor.

In some embodiments, the first pixels 101 and the second pixels 102 generally include red subpixels R, green subpixels G and blue subpixels B. FIG. 2 and FIG. 3 only illustrate one subpixel arrangement mode of the red subpixels R, the green subpixels G and the blue subpixels B, but do not limit the subpixel arrangement mode of the present disclosure. A specific subpixel arrangement mode may be redesigned according to an actual requirement.

S102, when the display mode is monitored to be a partial display mode, for the first pixels 101 in the first display region M: a pre-stored first gamma curve Gamma A is called, corresponding display information is generated based on the first gamma curve Gamma A, and the first pixels 101 are driven; for the second pixels 102 in the second display region N: a pre-stored second gamma curve Gamma B is called, corresponding display information is generated based on the second gamma curve Gamma B, and the second pixels 102 are driven.

Figure 4:
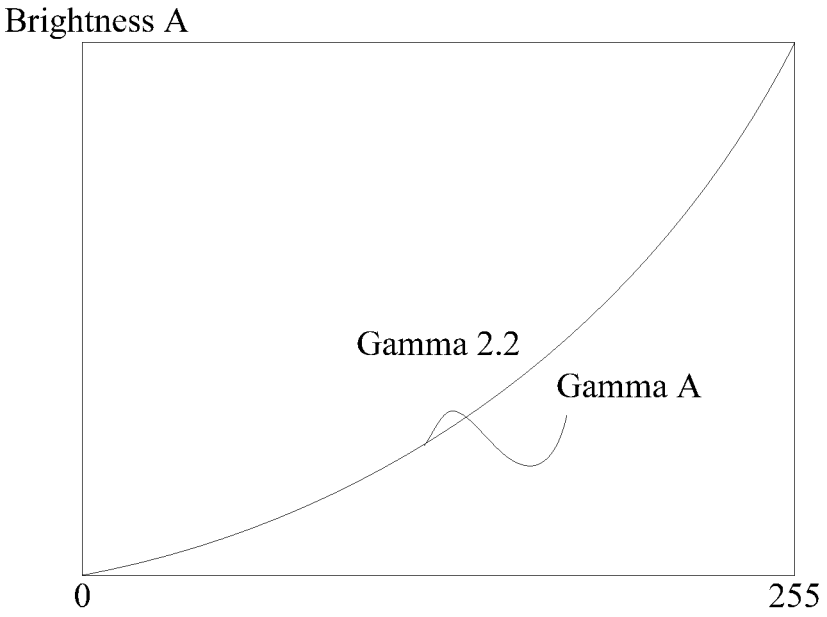
FIG. 4 is a schematic diagram of a first gamma curve in a driving method provided by an embodiment of the present disclosure.

As shown in FIG. 4, a maximum brightness value corresponding to a maximum gray-scale value (a general display panel has 256 gray-scale values, the maximum one of which is 255) in the first gamma curve Gamma A is a first maximum brightness value Brightness A.

Figure 5:
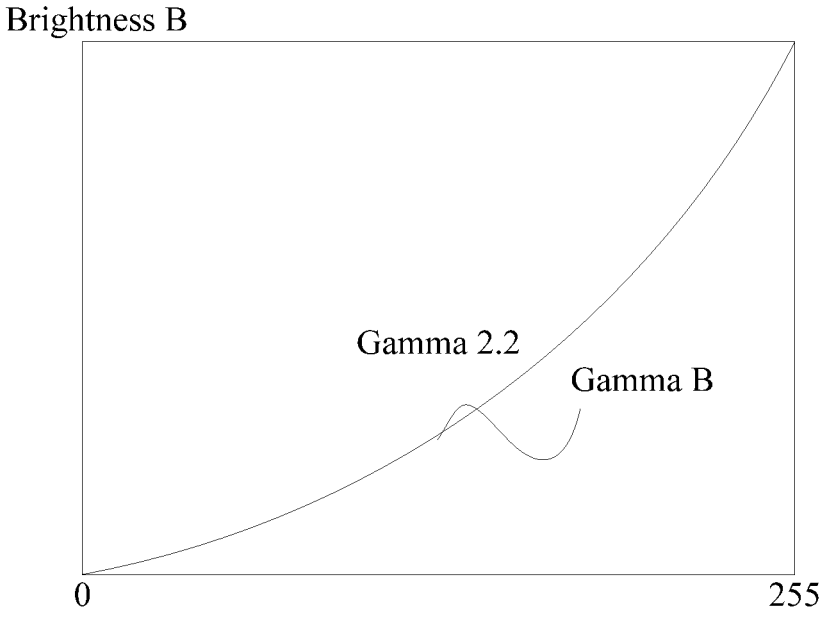
FIG. 5 is a schematic diagram of a second gamma curve in a driving method provided by an embodiment of the present disclosure.

As shown in FIG. 5, a maximum brightness value corresponding to a maximum gray-scale value (the maximum one is 255) in the second gamma curve Gamma B is a second maximum brightness value Brightness B.

Figure 6A:
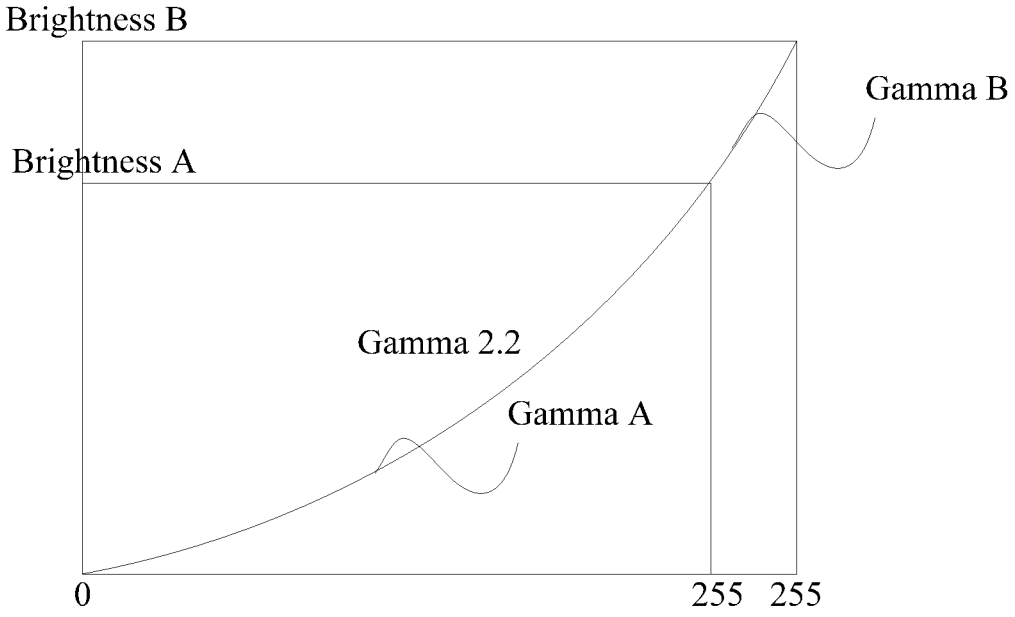
FIG. 6A and FIG. 6B are respectively comparison schematic diagrams of a first gamma curve and a second gamma curve in a driving method provided by an embodiment of the present disclosure.
Figure 6B:
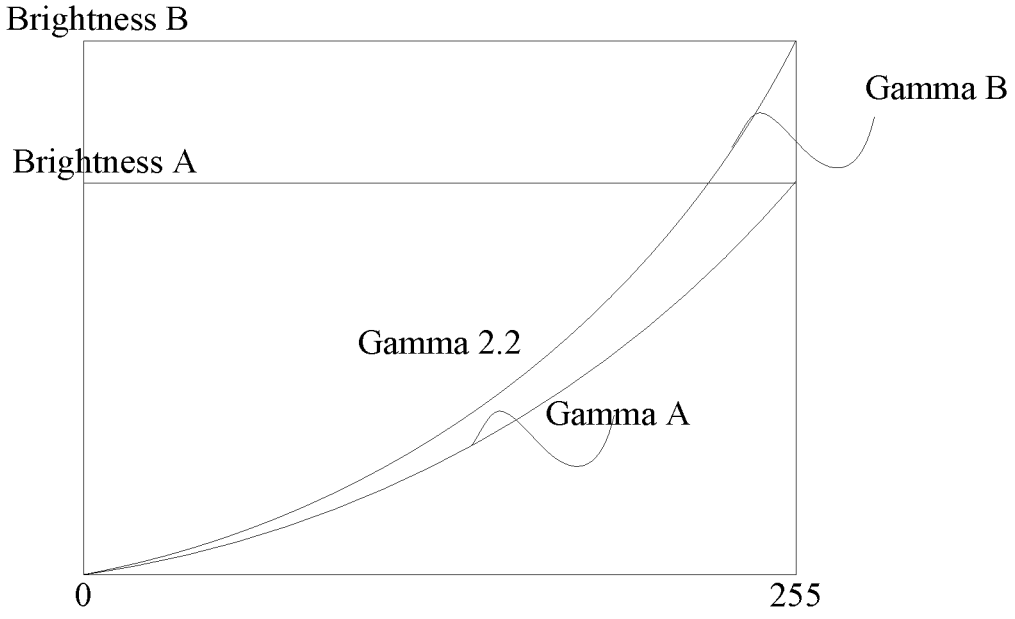

As shown in FIG. 6A, and FIG. 6B, the first maximum brightness value Brightness A is less than the second maximum brightness value Brightness B.

Furthermore, gamma values Gamma of the first gamma curve Gamma A and the second gamma curve Gamma B stored in the display panel are generally 2.2. The above is illustrated by taking the gamma value of 2.2 as an example. In actual application, the gamma value is not limited to 2.2, and may also be other values, and it is not limited here.

In FIG. 6A and FIG. 6B, in order to compare the first gamma curve Gamma A with the second gamma curve Gamma B, their curve graphs are combined in one graph. FIG. 6A and FIG. 6B illustrate non-normalized situations, and normalized situations are consistent with those in FIG. 4 and FIG. 5. FIG. 6A illustrates that coordinates of gray-scale values and coordinates of brightness values are not normalized, and FIG. 6B illustrates that when the coordinates of the gray-scale values are consistent, the brightness values are not normalized.

In some embodiments, the partial display mode when the display panel displays the picture may also be called a non-full-screen display mode. In one embodiment, when the first display region M displays information of fixed contents such as time/date/mobile phone signal, it can be considered that the display panel enters the partial display mode. At this time, the display panel is in the partial display mode generally when an APP for browsing a webpage, WeChat and the like is called. When the display panel is in the partial display mode during display of the picture, the content displayed in the first display region M is the fixed content, so that when the first display region M is relatively low in brightness, a user may also easily observe and acquire desired information with eyes.

Therefore, according to the driving method of the display panel, provided by the embodiments of the present disclosure, under the partial display mode, different gamma curves may be called for different display regions, to drive different regions of the same picture. In one embodiment, the first gamma curve Gamma A with relatively low brightness may be called for the first display region M provided with the under screen sensor, that is, the first display region M is driven by the first gamma curve Gamma A with the relatively low brightness. The second gamma curve Gamma B with relatively high brightness may be called for the second display region N in normal display, that is, the second display region N is driven by the second gamma curve Gamma B with the relatively high brightness. Therefore, the first display region M has lower brightness than the second display region N, and the shortened life caused by long-time high-brightness display of the first display region M may be avoided and prevented. Furthermore, under the partial display mode, compared with the second display region N, the first display region M may be supplied with lower current, or the supplied driving voltage has a smaller duty cycle, or the supplied driving voltage is lower, to prolong the display life of the first display region M.

In some embodiments, the above driving method provided by the embodiment of the present disclosure, as shown in FIG. 1, may further include the following steps.

S103, when the display mode is monitored to be a full-screen display mode, for the first pixels in the first display region and the second pixels in the second display region: the second gamma curve is called, corresponding display information is generated based on the second gamma curve, and the first pixels and the second pixels are driven.

In some embodiments, the full-screen display mode when the display panel displays the picture may be a dynamic display mode. In one embodiment, when a dynamic image is displayed, it can be considered that the display panel enters the full-screen display mode. At this time, the display panel is in the full-screen display mode generally when an APP for watching movies, playing games and the like is called. When the display panel is in the full-screen display mode during display of the picture, the content displayed in the first display region M is non-fixed information, and the first display region M needs to cooperate with the second display region N to display the information, so that at this time, the first display region M and the second display region N need to be driven by simultaneously calling the second gamma curve Gamma B with relatively high brightness, so that the first display region M and the second display region N have the consistent brightness. At this time, the brightness uniformity of the display needs to meet the target specification, such as being greater than 80 percent, which may let a viewer have a pleasant use experience and easily observe and acquire the dynamic information on the first display region M.

In some embodiments, in the above driving method provided by the embodiment of the present disclosure, when the display panel is under the full-screen display mode or the partial display mode, the step that the corresponding display information is generated based on the gamma curve from the first gamma curve or the second gamma curve includes the following steps.

First, a corresponding target brightness value is determined in the gamma curve according to a target gray-scale value. A smaller target gray-scale value corresponds to a smaller target brightness value.

Second, a corresponding driving voltage and light emitting time are determined according to the target brightness value. A smaller target brightness value corresponds to a lower driving voltage, or shorter light emitting time, but the display life of the pixels is longer.

In some embodiments, when target brightness values corresponding to the same target gray-scale value in the same gamma curve are the same, e.g., under the full-screen display mode, the target brightness values, corresponding to the same target gray-scale value, of the first pixels and the second pixels are the same. At this time, if the same parameters, namely the same driving voltage and the same light emitting time, are used to drive the first pixels and the second pixels, the actual light emitting brightness of the first display region M including the first pixels will be lower than the actual light emitting brightness of the second display region N including the second pixels.

In order to ensure that the first display region M and the second display region N have the consistent actual light emitting brightness at the same target gray-scale value. In one embodiment, in the above driving method provided by the embodiment of the present disclosure, under the full-screen display mode, the step that a corresponding driving voltage and light emitting time are determined according to the target brightness value may include that: the driving voltage corresponding to the first pixels is increased when the target brightness values corresponding to the first pixels and the second pixels are the same, the driving voltage corresponding to the first pixels is greater than the driving voltage corresponding to the second pixels, to increase the actual light emitting brightness of the first display region M including the first pixels and ensure that the first display region M and the second display region N have the consistent actual light emitting brightness; and/or, the light emitting time corresponding to the first pixels is prolonged when the target brightness values corresponding to the first pixels and the second pixels are the same, the light emitting time corresponding to the first pixels is greater than the light emitting time corresponding to the second pixels, to increase the actual light emitting brightness of the first display region M including the first pixels and ensure that the first display region M and the second display region N have the consistent actual light emitting brightness. In one embodiment, the light emitting time may be controlled by adjusting the duty cycle of a light emitting driving signal, and may also be controlled by adjusting the current of the light emitting driving signal.

In some embodiments, under the full-screen display mode, in case of the same target brightness values, compared with the second pixels of the second display region N, the first pixels of the first display region M are supplied with higher current, or the supplied driving voltage has a larger duty cycle, or the supplied driving voltage is higher, to compensate the problem of the reduced actual light emitting brightness caused by a low pixel density in the first display region M or a small opening area of the pixels and enable the first display region M and the second display region N to have the uniform actual light emitting brightness.

Since the increase of the driving voltage corresponding to the first pixels and the prolonging of the light emitting time corresponding to the first pixels may shorten the display life of the first pixels, under the partial display mode, the display life of the first pixels may be prolonged by reducing the target brightness values of the first pixels, to compensate the excessive consumption of the display life under the full-screen display mode.

In some embodiments, the same target gray-scale value in different gamma curves corresponds to different target brightness values. For the same target gray-scale value, the corresponding target brightness value in the first gamma curve is less than that in the second gamma curve. Therefore, under the partial display mode, for the same target gray-scale value, the target brightness value of the first display region is less than that of the second display region, that is, under the same target gray-scale value, the driving voltage and light emitting time corresponding to the first pixels may be equal to or less than the driving voltage and light emitting time corresponding to the second pixels, so that the display life of the first pixels is prolonged.

In some embodiments, in the above driving method provided by the embodiments of the present disclosure, in order to further prolong the display life of the first pixels under the partial display mode, in the partial display mode, the step that the corresponding driving voltage and light emitting time are determined according to the target brightness value may include: the driving voltage corresponding to the first pixels is reduced when the driving voltages corresponding to the first pixels and the second pixels are the same, the target brightness value corresponding to the first pixels is less than the target brightness value corresponding to the second pixels, namely when the same driving voltage is loaded to the first pixels and the second pixels, the first display region M has lower actual light emitting brightness than the second display region N; in other words, when the first pixels and the second pixels correspond to the same target gray-scale value, compared with the full-screen display mode, the driving voltage corresponding to the first pixels may be further reduced to further reduce the actual light emitting brightness of the first display region M and prolong the display life of the first pixels; and/or, the light emitting time corresponding to the first pixels is shortened when the light emitting times corresponding to the first pixels and the second pixels are the same, the target brightness value corresponding to the first pixels is less than the target brightness value corresponding to the second pixels, namely when the same light emitting time is loaded to the first pixels and the second pixels, the first display region M has lower actual light emitting brightness than the second display region N; in other words, when the first pixels and the second pixels correspond to the same target gray-scale value, compared with the full-screen display mode, the light emitting time corresponding to the first pixels may be further shortened to further reduce the actual light emitting brightness of the first display region M and prolong the display life of the first pixels.

In one embodiment, in the above driving method provided by the embodiments of the present disclosure, the first gamma curve may include a plurality of first sub gamma curves, and the second gamma curve may include a plurality of second sub gamma curves. The first maximum brightness values of the first sub gamma curves are different, and the second maximum brightness values of the second sub gamma curves are different. Furthermore, the number of the first sub gamma curves may be equal to the number of the second sub gamma curves. Furthermore, corresponding relationships between the first sub gamma curves and the light intensity of external environmental light and between the first sub gamma and internal fixed brightness, as well as between the second sub gamma curves and the light intensity of the external environmental light and between the second sub gamma and the internal fixed brightness are pre-established.

Based on this, the above driving method provided by the embodiments of the present disclosure may further include that: a brightness adjustment mode when the display panel displays the picture is monitored, where the brightness adjustment mode includes an automatic adjustment mode and a fixed brightness mode; under the partial display mode, when it is determined that the monitored brightness adjustment mode is the automatic adjustment mode, a desired first sub gamma curve and a desired second sub gamma curve are called according to received external environmental brightness; when the external environmental brightness is higher, the first sub gamma curve with a larger first maximum brightness value and the second sub gamma curve with a larger second maximum brightness value are called, namely in case of stronger external light, the overall display brightness of the first display region M and the second display region N under the partial display mode is higher; under the full-screen display mode, when it is determined that the monitored brightness adjustment mode is the automatic adjustment mode, a desired second sub gamma curve is called according to the received external environmental brightness; when the external environmental brightness is higher, the second sub gamma curve with a larger second maximum brightness value is called, namely in case of stronger external light, the overall display brightness of the first display region M and the second display region N under the full-screen display mode is higher.

In some embodiments, in the above driving method provided by the embodiment of the present disclosure, under the partial display mode, when it is determined that the monitored brightness adjustment mode is the fixed brightness mode, a desired first sub gamma curve and a desired second sub gamma curve may be called according to the currently selected fixed brightness; when the fixed brightness is higher, the first sub gamma curve with a larger first maximum brightness value and the second sub gamma curve with a larger second maximum brightness value are called, namely in case of higher fixed brightness, the overall display brightness of the first display region M and the second display region N under the partial display mode is higher.

In some embodiments, under the full-screen display mode, when it is determined that the monitored brightness adjustment mode is the fixed brightness mode, a desired second sub gamma curve is called according to the currently selected fixed brightness; when the selected fixed brightness is higher, the second sub gamma curve with a larger second maximum brightness value is called, namely in case of higher fixed brightness, the overall display brightness of the first display region M and the second display region N under the full-screen display mode is higher.

Based on the same inventive concept, an embodiment of the present disclosure further provides a driving device of a display panel. The principle of the driving device for solving the problems is similar to that of the foregoing driving method of the display panel, so that the implementation of the driving device may refer to the implementation of the driving method, and repeated contents are not described.

Figure 7:
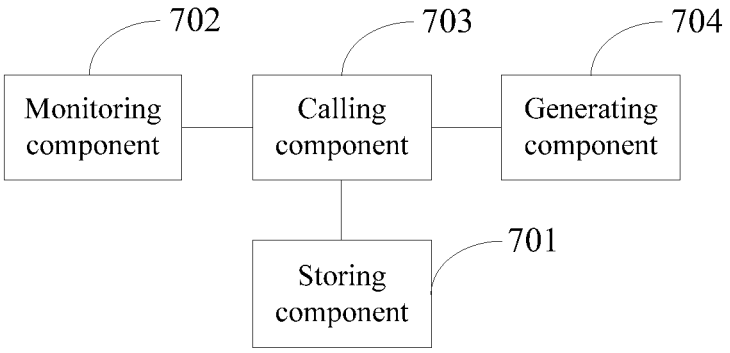
FIG. 7 is a structural schematic diagram of a driving device provided by an embodiment of the present disclosure.

A driving device of a display panel, provided by the embodiment of the present disclosure, as shown in FIG. 7, includes a storing component 701, a monitoring component 702, a calling component 703 and a generating component 704.

A storing component 701 is configured to store a first gamma curve and a second gamma curve, and a maximum brightness value corresponding to a maximum gray-scale value in the first gamma curve is a first maximum brightness value, and a maximum brightness value corresponding to a maximum gray-scale value in the second gamma curve is a second maximum brightness value, and the first maximum brightness value is less than the second maximum brightness value.

A monitoring component 702 is configured to monitor a display mode of the display panel when the display panel displays a picture, and the display panel includes a first display region and a second display region, and the first display region is a semi-transparent region configured to set an under screen sensor.

A calling component 703 is configured to call a pre-stored first gamma curve for first pixels in the first display region and call a pre-stored second gamma curve for second pixels in the second display region when the monitoring component monitors that the display mode is a partial display mode.

A generating component 704 is configured to generate corresponding display information based on the first gamma curve and drive the first pixels, and generate corresponding display information based on the second gamma curve and drive the second pixels.

In the above driving device provided by the embodiment of the present disclosure, the storing component 701 stores different gamma curves. Under the partial display mode, the calling component 703 may call different gamma curves for different display regions, so that the generating component 704 drives different regions of the same picture. In one embodiment, the calling component 703 may call the first gamma curve Gamma A with relatively low brightness for the first display region M provided with the under screen sensor, that is, the first display region M is driven by the first gamma curve Gamma A with the relatively low brightness. The calling component 703 may call the second gamma curve Gamma B with relatively high brightness for the second display region N in normal display, that is, the second display region N is driven by the second gamma curve Gamma B with the relatively high brightness. Therefore, the first display region M has lower brightness lower than the second display region N, and the shortened life caused by long-time high-brightness display of the first display region M may be avoided and prevented. Furthermore, compared with the full-screen display mode, the partial display mode has embodiments that lower current may be supplied to the first display region M, or the supplied driving voltage has a smaller duty cycle, or the supplied driving voltage is lower, to prolong the display life of the first display region M.

In some embodiments, in the above driving device provided by the embodiment of the present disclosure, the calling component 703 may also be configured to call the second gamma curve for the first pixels in the first display region and the second pixels in the second display region when the monitoring component monitors that the display mode is the full-screen display mode.

At this time, the generating component 704 may also be configured to generate corresponding display information based on the second gamma curve and drive the first pixels and the second pixels.

In one embodiment, in the above driving device provided by the embodiment of the present disclosure, the generating component 704 is In one embodiment configured to determine a corresponding target brightness value in the first gamma curve or the second gamma curve according to a target gray-scale value, and determine a corresponding driving voltage and light emitting time according to the target brightness value.

In the full-screen display mode, the driving voltage corresponding to the first pixels is increased when the target brightness values corresponding to the first pixels and the second pixels are the same, the driving voltage corresponding to the first pixels is greater than the driving voltage corresponding to the second pixels, and/or, the light emitting time corresponding to the first pixels is prolonged when the target brightness values corresponding to the first pixels and the second pixels are the same, the light emitting time corresponding to the first pixels is greater than the light emitting time corresponding to the second pixels.

In the partial display mode, the driving voltage corresponding to the first pixels is reduced when the driving voltages corresponding to the first pixels and the second pixels are the same, the target brightness value corresponding to the first pixels is less than the target brightness value corresponding to the second pixels, and/or, the light emitting time corresponding to the first pixels is shortened when the light emitting times corresponding to the first pixels and the second pixels are the same, the target brightness value corresponding to the first pixels is less than the target brightness value corresponding to the second pixels.

In one embodiment, in the above driving device provided by the embodiment of the present disclosure, the first gamma curve stored in the storing component 701 may include a plurality of first sub gamma curves, and the second gamma curve may include a plurality of second sub gamma curves. The first maximum brightness values of the first sub gamma curves are different, and the second maximum brightness values of the second sub gamma curves are different.

The monitoring component 702 may also be configured to monitor a brightness adjustment mode when the display panel displays the picture.

The calling component 703 may also be configured to call a desired first sub gamma curve and a desired second sub gamma curve according to received external environmental brightness when it is determined that the monitored brightness adjustment mode is an automatic adjustment mode under the partial display mode. If the external environmental brightness is higher, the first sub gamma curve with a larger first maximum brightness value and the second sub gamma curve with a larger second maximum brightness value are called.

The calling component 703 may also be configured to call a desired second sub gamma curve according to the received external environmental brightness when it is determined that the monitored brightness adjustment mode is an automatic adjustment mode under the full-screen display mode. If the external environmental brightness is higher, the second sub gamma curve with a larger second maximum brightness value is called.

The calling component 703 may also be configured to call a desired first sub gamma curve and a desired second sub gamma curve according to the currently selected fixed brightness when it is determined that the monitored brightness adjustment mode is a fixed brightness mode under the partial display mode. If the fixed brightness is higher, the first sub gamma curve with a larger first maximum brightness value and the second sub gamma curve with a larger second maximum brightness value are called.

The calling component 703 may also be configured to call a desired second sub gamma curve according to the currently selected fixed brightness when it is determined that the monitored brightness adjustment mode is a fixed brightness mode under the full-screen display mode. If the selected fixed brightness is higher, the second sub gamma curve with a larger second maximum brightness value is called.

Based on the same inventive concept, the embodiment of the present disclosure further provides a display device. The display device may be: any product or component having a display function, such as a mobile phone, a tablet computer, a television, a display, a notebook computer, a digital photo frame and a navigator.

Figure 8:
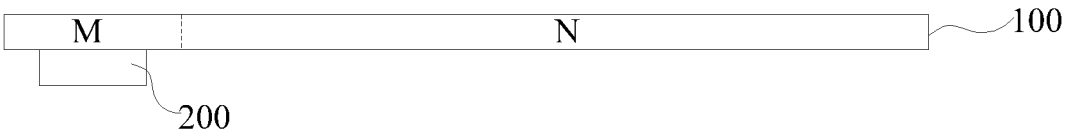
FIG. 8 is a structural schematic diagram of a display device provided by an embodiment of the present disclosure.

In one embodiment, the display device provided by the embodiment of the present disclosure, as shown in FIG. 8, includes: a display panel 100, and the display panel 100 includes a first display region M and a second display region N; the first display region M is a semi-transparent region for setting an under screen sensor; a sensor 200 arranged corresponding to the first display region M; and the above driving device (not shown in the figure) provided by the embodiment of the present disclosure.

According to the display device provided by the embodiment of the present disclosure, under the partial display mode, the driving device may call different gamma curves for different display regions, to drive different regions of the same picture. In one embodiment, the first gamma curve Gamma A with relatively low brightness may be called for the first display region M provided with the under screen sensor, that is, the first display region M is driven by the first gamma curve Gamma A with the relatively low brightness. The second gamma curve Gamma B with relatively high brightness may be called for the second display region N in normal display, that is, the second display region N is driven by the second gamma curve Gamma B with the relatively high brightness. Therefore, the first display region M has lower brightness lower than the second display region N, and the shortened life caused by long-time high-brightness display of the first display region M may be avoided and prevented. Furthermore, compared with a full-screen display mode, the partial display mode has the advantages that lower current may be supplied to the first display region M, or the supplied driving voltage has a smaller duty cycle, or the supplied driving voltage is lower, to prolong the display life of the first display region M.

In one embodiment, in the above display device provided by the embodiment of the present disclosure, the display panel 100 may be: any display panel including pixel structures, such as a liquid crystal display panel, an organic electroluminescence display panel and a plasma display panel. The display panel may be a rigid display panel, or a flexible display panel, and it is not limited here.

In one embodiment, in the above display device provided by the embodiment of the present disclosure, the sensor 200 may be at least one of a light sensor, a distance sensor, a camera, a receiver, a depth sensor and an iris recognition sensor, and it is not limited here.

In one embodiment, in the above display device provided by the embodiment of the present disclosure, as shown in FIG. 2, a pixel density of first pixels 101 in the first display region M of the display panel 100 may be less than that of second pixels 102 in the second display region N, that is, the second pixels 102 in the second display region N are normally arranged. The number of the first pixels 101 within a unit area in the first display region M is decreased to reduce the pixel density of the first pixels 101, to set the light transmittance region T in the first display region M; and/or, as shown in FIG. 3, an opening area of the first pixels 101 in the first display region M is less than that of the second pixels 102 in the second display region N, that is, the second pixels 102 in the second display region N are normally arranged. An opening region of each of the first pixels 101 in the first display region M is narrowed, to set the light transmittance region T in the first display region M to realize the image acquisition and other functions of the under screen sensor. In one embodiment, the first pixels 101 and the second pixels 102 generally include red subpixels R, green subpixels G and blue subpixels B.

According to the driving method and driving device of the display panel and the display device which are provided by the embodiments of the present disclosure, under the partial display mode, different gamma curves may be called for different display regions, to drive different regions of the same picture. In one embodiment, the first gamma curve with relatively low brightness may be called for the first display region provided with the under screen sensor, that is, the first display region is driven by the first gamma curve with the relatively low brightness. The second gamma curve with relatively high brightness may be called for the second display region in normal display, that is, the second display region is driven by the second gamma curve with the relatively high brightness. Therefore, the first display region has lower brightness than the second display region, and the shortened life caused by long-time high-brightness display of the first display region may be avoided and prevented. Furthermore, compared with a full-screen display mode, the partial display mode has the advantages that lower current may be supplied to the first display region, or the supplied driving voltage has a smaller duty cycle, or the supplied driving voltage is lower, to prolong the display life of the first display region.

What is claimed is:

1. A driving method of a display panel, comprising:

monitoring a display mode of the display panel when the display panel displays a picture, wherein the display panel comprises a first display region and a second display region, and the first display region is a semi-transparent region configured to set an under screen sensor;

when the display mode is monitored to be a partial display mode, for first pixels in the first display region: calling a pre-stored first gamma curve, generating corresponding display information based on the first gamma curve, and driving the first pixels; for second pixels in the second display region: calling a pre-stored second gamma curve, generating corresponding display information based on the second gamma curve, and driving the second pixels, wherein a maximum brightness value corresponding to a maximum gray-scale value in the first gamma curve is a first maximum brightness value, a maximum brightness value corresponding to a maximum gray-scale value in the second gamma curve is a second maximum brightness value, and the first maximum brightness value is less than the second maximum brightness value;

wherein the method further comprises:

when the display mode is monitored to be a full-screen display mode, for the first pixels in the first display region and the second pixels in the second display region: calling the second gamma curve, generating corresponding display information based on the second gamma curve, and driving the first pixels and the second pixels;

wherein the first gamma curve comprises a plurality of first sub gamma curves; the second gamma curve comprises a plurality of second sub gamma curves; first maximum brightness values of the first sub gamma curves are different second maximum brightness values of the second sub gamma curves are different;

wherein the driving method further comprises:

monitoring a brightness adjustment mode when the display panel displays a picture;

in the partial display mode, when determining that the monitored brightness adjustment mode is an automatic adjustment mode, calling the first sub gamma curve and the second sub gamma curve according to received external environmental brightness, wherein when the external environmental brightness is higher, the first sub gamma curve with a larger first maximum brightness value and the second sub gamma curve with a larger second maximum brightness value are called; and in the full-screen display mode, when determining that the monitored brightness adjustment mode is an automatic adjustment mode, calling the second sub gamma curve according to received external environmental brightness, wherein when the external environmental brightness is higher, the second sub gamma curve with a larger second maximum brightness value is called.

2. The driving method according to claim 1, further comprising:

in the partial display mode, when determining that the monitored brightness adjustment mode is a fixed brightness mode, calling the first sub gamma curve and the second sub gamma curve according to the currently selected fixed brightness, wherein when the fixed brightness is higher, the first sub gamma curve with a larger first maximum brightness value and the second sub gamma curve with a larger second maximum brightness value are called; and in the full-screen display mode, when determining that the monitored brightness adjustment mode is a fixed brightness mode, calling the second sub gamma curve desired according to the currently selected fixed brightness, wherein when the selected fixed brightness is higher, the second sub gamma curve with a larger second maximum brightness value is called.

3. The driving method according to claim 1, further comprising:

when the display mode is monitored to be a full-screen display mode, for the first pixels in the first display region and the second pixels in the second display region: calling the second gamma curve, generating corresponding display information based on the second gamma curve, and driving the first pixels and the second pixels.

4. The driving method according to claim 3, wherein the generating corresponding display information based on a gamma curve from the first gamma curve or the second gamma curve comprises:

determining a corresponding target brightness value in the gamma curve according to a target gray-scale value; and determining a corresponding driving voltage and light emitting time according to the target brightness value.

5. The driving method according to claim 4, wherein in the full-screen display mode, the determining the corresponding driving voltage and light emitting time according to the target brightness value comprises:

increasing a driving voltage corresponding to the first pixels, such that when a target brightness value corresponding to the first pixels is the same as a target brightness value corresponding to the second pixels, the driving voltage corresponding to the first pixels is greater than a driving voltage corresponding to the second pixels; and/or, prolonging light emitting time corresponding to the first pixels, such that when a target brightness value corresponding to the first pixels is the same as a target brightness value corresponding to the second pixels, the light emitting time corresponding to the first pixels is greater than light emitting time corresponding to the second pixels.

6. The driving method according to claim 4, wherein in the partial display mode, the determining the corresponding driving voltage and light emitting time according to the target brightness value comprises:

decreasing a driving voltage corresponding to the first pixels, such that when the driving voltage corresponding to the first pixels is the same as a driving voltage corresponding to the second pixels, a target brightness value corresponding to the first pixels is less than a target brightness value corresponding to the second pixels; and/or, shortening light emitting time corresponding to the first pixels such that when light emitting time corresponding to the first pixels is the same as light emitting time corresponding to the second pixels, a target brightness value corresponding to the first pixels is less than a target brightness value corresponding to the second pixels.

7. A driving device of a display panel, comprising:

a storing component, configured to store a first gamma curve and a second gamma curve, wherein a maximum brightness value corresponding to a maximum gray-scale value in the first gamma curve is a first maximum brightness value, and a maximum brightness value corresponding to a maximum gray-scale value in the second gamma curve is a second maximum brightness value, and the first maximum brightness value is less than the second maximum brightness value;

a monitoring component, configured to monitor a display mode of the display panel when the display panel displays a picture, wherein the display panel comprises a first display region and a second display region, and the first display region is a semi-transparent region configured to set an under screen sensor;

a calling component, configured to call a pre-stored first gamma curve for first pixels in the first display region and call a pre-stored second gamma curve for second pixels in the second display region when the monitoring component monitors that the display mode is a partial display mode; and a generating component, configured to generate corresponding display information based on the first gamma curve and drive the first pixels, and generate corresponding display information based on the second gamma curve and drive the second pixels;

wherein the first gamma curve stored by the storing component comprises a plurality of first sub gamma curves; the second gamma curve stored by the storing component comprises a plurality of second sub gamma curves; first maximum brightness values of the first sub gamma curves are different second maximum brightness values of the second sub gamma curves are different;

wherein the monitoring component is further configured to monitor a brightness adjustment mode when the display panel displays a picture;

wherein the calling component is also configured to:

call the first sub gamma curve and the second sub gamma curve according to received external environmental brightness when determining that the monitored brightness adjustment mode is an automatic adjustment mode in the partial display mode, wherein when the external environmental brightness is higher, the first sub gamma curve with a larger first maximum brightness value and the second sub gamma curve with a larger second maximum brightness value are called;

call the second sub gamma curve according to received external environmental brightness when determining that the monitored brightness adjustment mode is an automatic adjustment mode in the full-screen display mode, wherein when the external environmental brightness is higher, the second sub gamma curve with a larger second maximum brightness value is called;

call the first sub gamma curve and the second sub gamma curve according to the currently selected fixed brightness when determining that the monitored brightness adjustment mode is a fixed brightness mode in the partial display mode, wherein when the fixed brightness is higher, the first sub gamma curve with a larger first maximum brightness value and the second sub gamma curve with a larger second maximum brightness value are called; and call the second sub gamma curve desired according to the currently selected fixed brightness when determining that the monitored brightness adjustment mode is a fixed brightness mode in the full-screen display mode, wherein when the selected fixed brightness is higher, the second sub gamma curve with a larger second maximum brightness value is called.

8. The driving device according to claim 7, wherein the calling component is further configured to call the second gamma curve for the first pixels in the first display region and the second pixels in the second display region when the monitoring component monitors that the display mode is a full-screen display mode; and the generating component is further configured to generate corresponding display information based on the second gamma curve and drive the first pixels and the second pixels.

9. The driving device according to claim 8, wherein in the full-screen display mode, a driving voltage corresponding to the first pixels is increased such that when a target brightness value corresponding to the first pixels is the same as a target brightness value corresponding to the second pixels, the driving voltage corresponding to the first pixels is greater than a driving voltage corresponding to the second pixels, and/or, light emitting time corresponding to the first pixels is prolonged such that when a target brightness value corresponding to the first pixels is the same as a target brightness value corresponding to the second pixels, the light emitting time corresponding to the first pixels is greater than light emitting time corresponding to the second pixels; and in the partial display mode, a driving voltage corresponding to the first pixels is decreased such that when the driving voltage corresponding to the first pixels is the same as a driving voltage corresponding to the second pixels, a target brightness value corresponding to the first pixels is less than a target brightness value corresponding to the second pixels, and/or, light emitting time corresponding to the first pixels is shortened such that when light emitting time corresponding to the first pixels is the same as light emitting time corresponding to the second pixels, a target brightness value corresponding to the first pixels is less than a target brightness value corresponding to the second pixels.

10. The driving device according to claim 8, wherein the generating component is further configured to determine a corresponding target brightness value in the first gamma curve or the second gamma curve according to a target gray-scale value, and determine a corresponding driving voltage and light emitting time according to the target brightness value.

11. A display device, comprising:

a display panel, comprising a first display region and a second display region, wherein the first display region is a semi-transparent region configured to set an under screen sensor;

a sensor arranged corresponding to the first display region; and a driving device comprising:

a storing component, configured to store a first gamma curve and a second gamma curve, wherein a maximum brightness value corresponding to a maximum gray-scale value in the first gamma curve is a first maximum brightness value, and a maximum brightness value corresponding to a maximum gray-scale value in the second gamma curve is a second maximum brightness value, and the first maximum brightness value is less than the second maximum brightness value;

a monitoring component, configured to monitor a display mode of the display panel when the display panel displays a picture, wherein the display panel comprises a first display region and a second display region, and the first display region is a semi-transparent region configured to set an under screen sensor;

a calling component, configured to call a pre-stored first gamma curve for first pixels in the first display region and call a pre-stored second gamma curve for second pixels in the second display region when the monitoring component monitors that the display mode is a partial display mode; and a generating component, configured to generate corresponding display information based on the first gamma curve and drive the first pixels, and generate corresponding display information based on the second gamma curve and drive the second pixels;

wherein the first gamma curve stored by the storing component comprises a plurality of first sub gamma curves; the second gamma curve stored by the storing component comprises a plurality of second sub gamma curves; first maximum brightness values of the first sub gamma curves are different second maximum brightness values of the second sub gamma curves are different;

wherein the monitoring component is further configured to monitor a brightness adjustment mode when the display panel displays a picture;

wherein the calling component is also configured to:

call the first sub gamma curve and the second sub gamma curve according to received external environmental brightness when determining that the monitored brightness adjustment mode is an automatic adjustment mode in the partial display mode, wherein when the external environmental brightness is higher, the first sub gamma curve with a larger first maximum brightness value and the second sub gamma curve with a larger second maximum brightness value are called;

call the second sub gamma curve according to received external environmental brightness when determining that the monitored brightness adjustment mode is an automatic adjustment mode in the full-screen display mode, wherein when the external environmental brightness is higher, the second sub gamma curve with a larger second maximum brightness value is called;

call the first sub gamma curve and the second sub gamma curve according to the currently selected fixed brightness when determining that the monitored brightness adjustment mode is a fixed brightness mode in the partial display mode, wherein when the fixed brightness is higher, the first sub gamma curve with a larger first maximum brightness value and the second sub gamma curve with a larger second maximum brightness value are called; and call the second sub gamma curve desired according to the currently selected fixed brightness when determining that the monitored brightness adjustment mode is a fixed brightness mode in the full-screen display mode, wherein when the selected fixed brightness is higher, the second sub gamma curve with a larger second maximum brightness value is called.

12. The display device according to claim 11, wherein a pixel density of first pixels in the first display region is less than a pixel density of second pixels in the second display region; and/or, an opening area of first pixels in the first display region is less than an opening area of second pixels in the second display region.

13. The display device according to claim 11, wherein the sensor is at least one of a light sensor, a distance sensor, a camera, a receiver, a depth sensor or an iris recognition sensor.

14. The display device according to claim 11, wherein the calling component is further configured to call the second gamma curve for the first pixels in the first display region and the second pixels in the second display region when the monitoring component monitors that the display mode is a full-screen display mode; and the generating component is further configured to generate corresponding display information based on the second gamma curve and drive the first pixels and the second pixels.

15. The display device according to claim 14, wherein in the full-screen display mode, a driving voltage corresponding to the first pixels is increased such that when a target brightness value corresponding to the first pixels is the same as a target brightness value corresponding to the second pixels, the driving voltage corresponding to the first pixels is greater than a driving voltage corresponding to the second pixels, and/or, light emitting time corresponding to the first pixels is prolonged such that when a target brightness value corresponding to the first pixels is the same as a target brightness value corresponding to the second pixels, the light emitting time corresponding to the first pixels is greater than light emitting time corresponding to the second pixels; and in the partial display mode, a driving voltage corresponding to the first pixels is decreased such that when the driving voltage corresponding to the first pixels is the same as a driving voltage corresponding to the second pixels, a target brightness value corresponding to the first pixels is less than a target brightness value corresponding to the second pixels, and/or, light emitting time corresponding to the first pixels is shortened such that when light emitting time corresponding to the first pixels is the same as light emitting time corresponding to the second pixels, a target brightness value corresponding to the first pixels is less than a target brightness value corresponding to the second pixels.

16. The display device according to claim 14, wherein the generating component is further configured to determine a corresponding target brightness value in the first gamma curve or the second gamma curve according to a target gray-scale value, and determine a corresponding driving voltage and light emitting time according to the target brightness value.

* * * * *